United States Patent [19]

Van Aller et al.

[11] Patent Number: 4,943,711

[45] Date of Patent: Jul. 24, 1990

[54] IMAGE INTENSIFIER TUBE WITH INPUT SCREEN HAVING A PROFILE WHICH SATISFIES A HIGHER DEGREE POLYNOMIAL

[75] Inventors: Gerardus Van Aller; Jan Wieldraaijer, both of Heerlen, Netherlands

[73] Assignee: U.S. Philips Corporation, New York, N.Y.

[21] Appl. No.: 330,233

[22] Filed: Mar. 29, 1989

[30] Foreign Application Priority Data

Apr. 22, 1988 [NL] Netherlands ..... 8801050

[51] Int. Cl.[5] ..... H01J 31/50

[52] U.S. Cl. ..... 250/213 VT; 313/530

[58] Field of Search ..... 250/213 VT; 313/525, 313/530, 541, 544

[56] References Cited

U.S. PATENT DOCUMENTS 3,300,668 1/1967 Niklas ..... 250/213 VT 3,683,194 8/1972 Levin ..... 250/213 VT

*Primary Examiner*—David C. Nelms

*Assistant Examiner*—Sherrie Hsia

[57] ABSTRACT

In an image intensifier tube the input screen has a profile which is determined by a higher degree polynomial of which the constant term and the first order term are both zero. As a result of this the profile shows no local inhomogeneities and the profile may be adapted to an optical imaging by the electron-optical system of the photocathode on the output screen.

6 Claims, 1 Drawing Sheet

IMAGE INTENSIFIER TUBE WITH INPUT SCREEN HAVING A PROFILE WHICH SATISFIES A HIGHER DEGREE POLYNOMIAL

The invention relates to an image intensifier tube having a curved input screen, an output screen, and an electron-optical system for imaging photoelectrons emanating from the photocathode on the output screen.

Such an image intensifier tube is known from U.S. Pat. No. 3,784,830. In an X-ray image intensifier tube described in said Specification the input screen has a profile with a radius of curvature increasing towards the edge. Although an improvement in the imaging with respect to a purely spherical screen can be realized with this, imaging errors prove to occur in this form also with optimization of the electron-optical system, which errors are a result of a non-flat image plane at the area of the output screen.

It has been tried in EP 159 590 to improve this by a non-linear variation of the screen curvature. The image plane indeed shows an improvement but an annular brightness variation in the image formation occurs which may be assumed to be caused by the local transition in the radius of curvature of the screen.

It is the object of the invention to mitigate the above-mentioned disadvantage and for that purpose an image intensifier tube of the type mentioned in the opening paragraph is characterized according to the invention in that on a side supporting the photocathode the input screen has a profile with a rise of arc which expressed in a radius r taken radially from a screen centre satisfies a third or higher order degree polynomial without constant and first order term.

Since the curvature of an input screen in an image intensifier tube according to the invention has the form of a polynomial, no local inhomogeneities occur and brightness variations which are the result thereof have been avoided. By the choice of remaining coefficients of the polynomial the screen curvature can be optimized for an optimum imaging on the output screen. A third degree polynomial or a higher degree polynomial, for example, may optionally be used for a further reduction of electron-optical distortion and image field curvature.

The number of remaining coefficients increases with the degree of the polynomial and hence also the number of degrees of freedom in the screen profile.

In a preferred embodiment the input screen comprises a metal support, a phosphor layer and a photocathode and as such forms an input screen for, for example, an X-ray image intensifer tube.

In a further preferred embodiment the input screen comprises a photocathode which is provided directly on a support which is transparent to radiation for which the photocathode is sensitive. For the formation of both metal and, for example, glass supports, a profile adapted to a desired polynomial may be used.

Figure 1:
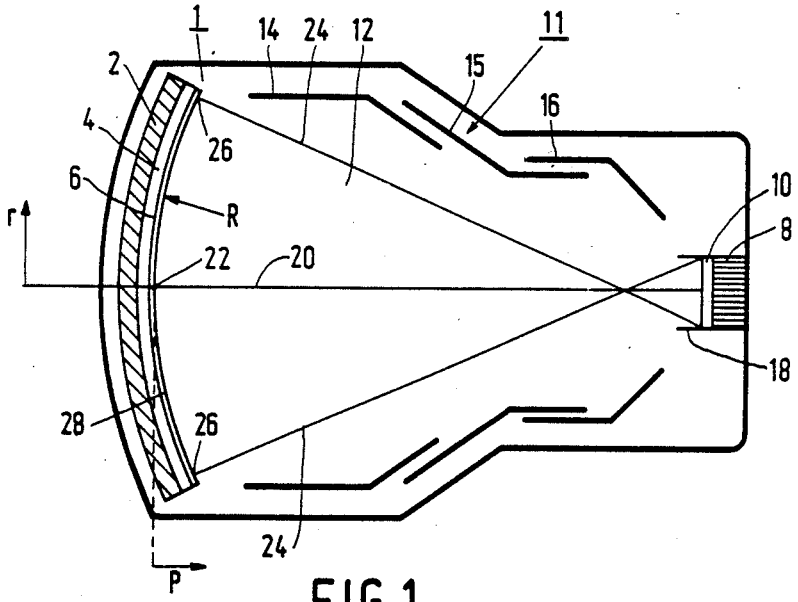

A few preferred embodiments according to the invention will now be described in greater detail with reference to the drawing, in which FIG. 1 shows very diagrammatically an image intensifier tube, for example, an X-ray image intensifier tube according to the invention, and FIG. 2 shows a few examples for the variation of the radius of curvature R as a function of the radial axial distance r.

For a more detailed description of an X-ray image intensifier tube as such reference may be made to the prior art, for example, EP 159 590.

Of such a tube FIG. 1 shows an input screen 1 with in this case a metal support 2, a phosphor layer 4 and a photocathode 6, an output screen 8 with a luminescent layer 10 and therebetween an electron-optical system 11 which, together with the input screen and the output screen, is accommodated in a housing 12 to be evacuated and in this case comprises three focusing electrodes 14, 15 and 16 and an output electrode 18.

The focusing system is preferably constructed so that various input screen diameters can be displayed on the output screen. Photo-electrons are directed, by means of the electron-optical system, from the photocathode to the output screen which, for example, is at a 24 kV higher potential along a track 20 for a central screen spot 22 and along tracks 24 for a more peripheral screen ring 26. The profile of the screen, but in particular the free surface 28 of the photocathode, is determined by a polynomial of the form $P=a_3r^3+a_2r^2$ for a third degree polynomal and, for example, $p=a_5r^5+a_4r^4+a_3r^3+a_2r^2$ for a fifth degree polynomial. Herein P is the distance measured from a plane through the central screen spot 22 transversely through the axis 20 and r is the radial distance from that point, while the coefficients a may be freely chosen. Because the rise of arc P is measured from the central screen spot 22 the polynomial comprises no constant term and no first degree term because for practical screens the first derivative of the polynomial there is also equal to zero. With the choice of the degree of the polynomial and with the choice of the coefficients a therein the profile may be chosen. The choice may be determined, for example, by the properties of the electron-optical system, or in fact both may be optimized collectively for an image field curvature-free display of the photocathode on the output screen. For example, when a fibre optic output window is used this may also be given profile for a possibly better collective optimization. For this purpose, for an optimum imaging the electron-optical system or the input screen profile or rather again both may be collectively optimized.

FIG. 2 shows several examples for radii of curvature of screens in which the reciprocal value 1/R for the radius of curvature is shown as a function from the radial distance to the axis r.

Figure 2A:
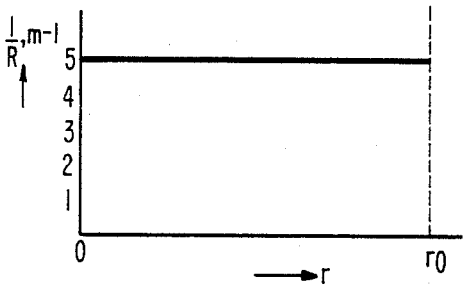
Figure 2B:
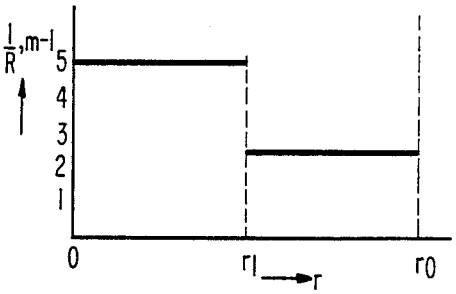

FIG. 2*a* shows this variation for a spherical screen having a radius of curvature of 0.2 m, FIG. 2*b* shows the variation for a screen having between $r=0$ and $r=r'$ a radius of curvature of 0.2 m and between $r'$ and $r_0$ a radius of curvature of 0.4 m. The electron-optical distortion has been reduced together with image filed curvature which always is a function of r, but in an image to be formed the transition at $r'$ will be visible.

Figure 2C:
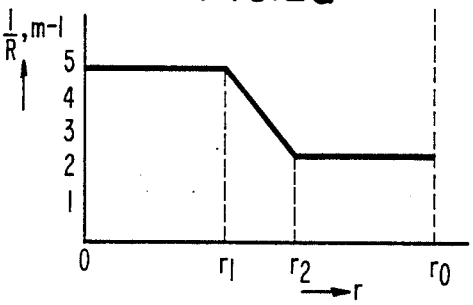

With a variation as shown in FIG. 2*c* it has been tried to compensate for this but in fact neither an optimum compensation nor a full evasion of screen transitions expressed in an image to be formed, has been realized.

Figure 2D:
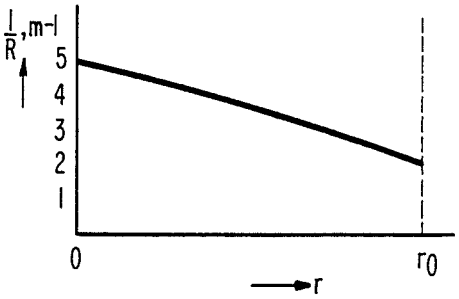

FIG. 2*d* shows a screen profile according to a preferred embodiment of the invention with a smoother transition of $R=0.2$ m for the centre of the screen to $r=0.5$ m for the edge of the screen. In the example shown this has been realized with the polynomial $P=ar^3+br^2$ with $a=-0.2$ and $b=2.5$. As a result of this an optimum reduction in image curvature and distortion of the electron-optical system used has been realized for a given tube without the possibility of image disturbing screen transitions.

We claim:

1. An image intensifier tube having a curved input screen (1), an output screen (8) and an electron-optical system (11) for imaging photo-electrons emanating from the photocathode on the output screen, characterized in that on a side supporting the photocathode the input screen has a profile with a rise of arc (P) which expressed in a radius (r) take radially from a screen centre (22) satisfies a third or higher degree polynomial without constant and first order term.

2. An image intensifier tube as claimed in claim 1, characterized in that coefficients of the polynomial for corrections of the image field curvature and distortion of the electron-optical system are optimized.

3. An image intensifier tube as claimed in claim 1 or 2, characterized in that the profile of the input screen satisfies a third degree polynomial.

4. An image intensifier tube as claimed in claim 1 or 2, characterized in that the profile of the input screen satisfies a fifth degree polynomial.

5. An image intensifier tube as claimed in claim 1, characterized in that the input screen comprises a metal support, a luminescent layer and a photocathode.

6. An image intensifier tube as claimed in claim 1 or 2, characterized in that the input screen comprises a photocathode provided on a support which is transparent to radiation for which the photocathode is sensitive.

* * * * *